US009117353B2

(12) United States Patent
Rousseau et al.

(10) Patent No.: US 9,117,353 B2
(45) Date of Patent: Aug. 25, 2015

(54) SURVEILLANCE METHOD FOR MONITORING AN OBJECT OF VALUE

(75) Inventors: Frédéric Rousseau, Montigny le Bretonneux (FR); Manuel Henry, Tilly (FR)

(73) Assignee: CASSIDIAN SAS, Elancourt (FR)

( * ) Notice: Subject to any disclaimer, the term of this patent is extended or adjusted under 35 U.S.C. 154(b) by 712 days.

(21) Appl. No.: 13/059,466

(22) PCT Filed: Jul. 30, 2009

(86) PCT No.: PCT/FR2009/051541

§ 371 (c)(1),
(2), (4) Date: Feb. 17, 2011

(87) PCT Pub. No.: WO2010/020728

PCT Pub. Date: Feb. 25, 2010

(65) Prior Publication Data

US 2011/0148635 A1 Jun. 23, 2011

(30) Foreign Application Priority Data

Aug. 20, 2008 (FR) ..... 08 04657

(51) Int. Cl.
*G08B 13/14* (2006.01)
*G08B 25/00* (2006.01)

(52) U.S. Cl.
CPC ..... *G08B 13/1436* (2013.01); *G08B 25/009* (2013.01)

(58) Field of Classification Search
USPC ..... 340/568.1, 870.01, 10.42, 5.8; 361/90
See application file for complete search history.

(56) References Cited

U.S. PATENT DOCUMENTS

| | | | | |
|---|---|---|---|---|
| 7,129,842 | B2 * | 10/2006 | Hope | 340/568.1 |
| 8,024,980 | B2 * | 9/2011 | Arms et al. | 73/763 |
| 8,316,429 | B2 * | 11/2012 | Long et al. | 726/12 |
| 2002/0115444 | A1 * | 8/2002 | Yu et al. | 455/456 |
| 2005/0105231 | A1 * | 5/2005 | Hamel et al. | 361/90 |
| 2006/0214806 | A1 * | 9/2006 | Clifford et al. | 340/573.1 |
| 2006/0256076 | A1 * | 11/2006 | Liou et al. | 345/156 |
| 2007/0144396 | A1 * | 6/2007 | Hamel et al. | 102/472 |
| 2009/0303076 | A1 * | 12/2009 | Setiadi et al. | 340/870.01 |

FOREIGN PATENT DOCUMENTS

WO WO 2006/057804 A 6/2006

OTHER PUBLICATIONS

International Search Report corresponding to PCT/FR2009/051541, dated Apr. 2, 2010.

* cited by examiner

*Primary Examiner* — Jennifer Mehmood
*Assistant Examiner* — Omar Casillashernandez
(74) *Attorney, Agent, or Firm* — Pillsbury Winthrop Shaw Pittman, LLP

(57) ABSTRACT

A method of monitoring an object of value to optimize energy consumption, the object of value being equipped with an event detection device including: a circuit configured to provide contactless communication with a remote entity; a sensor configured to detect an event related to the monitoring of an object of value; a unit configured to collect energy; the method including a first step of collecting energy by the detection device; a second step, started following the detection of an event by the detection device, in the course of which energy collected during the first step is restored such that: the detection device activates at least one contactless communication circuit of a remote entity or searches for one; the detection device transmits to the contactless communication circuit of the remote entity information related to the detected event.

20 Claims, 4 Drawing Sheets

SURVEILLANCE METHOD FOR MONITORING AN OBJECT OF VALUE

CROSS REFERENCE TO RELATED APPLICATIONS

Figure 1:
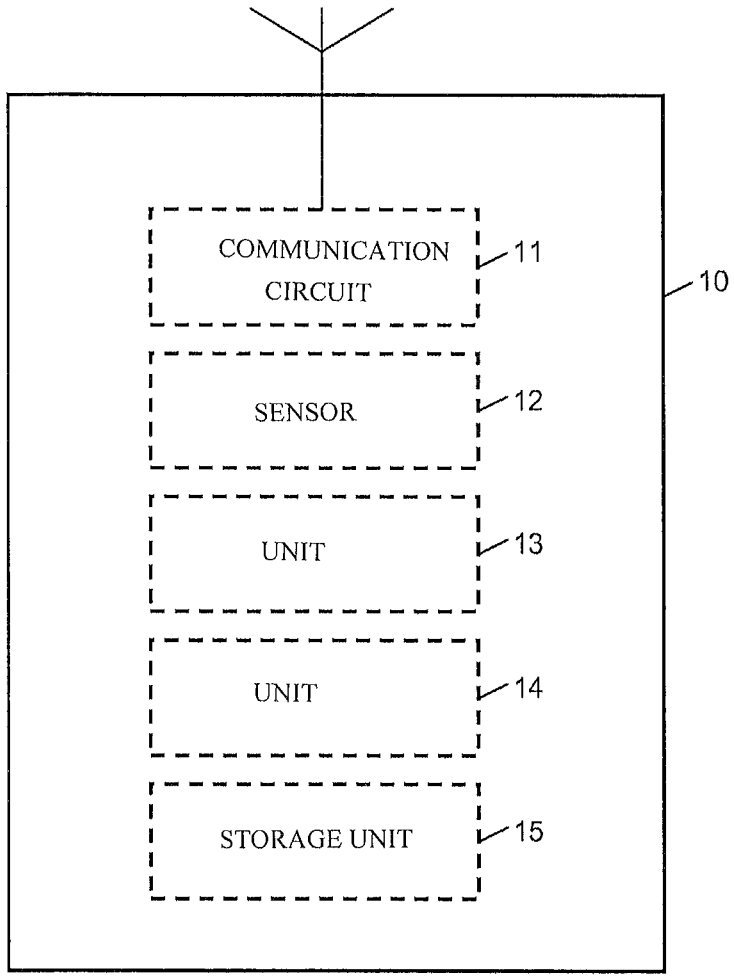

This application is the U.S. National Stage of PCT/FR2009/051541, filed Jul. 30, 2009, which in turn claims priority to French Application No. 0804657, filed Aug. 20, 2008. The content of both application are incorporated herein by reference in their entirety.

The invention relates to a method and device for monitoring an object of value, and more precisely a device designed to enable alarms to be raised upon the detection of events related to the use of a weapon.

Generally, solutions aiming to facilitate and automate the monitoring of objects of value exist. Such solutions enable an automatic alarm to be raised to an alarm management server by means of a mobile radiocommunication terminal.

These solutions comprise sensors physically connected to the object to be monitored and connected to the mobile communication terminal.

In addition, existing solutions are based on an energy supply system that cannot be applied to all situations. In certain known systems, the energy supply of the sensor is obtained from the mobile communication terminal through a wire connection between the object of value and the mobile communication terminal. Due to the presence of a wire connection, such solutions are not suitable in cases where a significant level of mobility is necessary, particularly when sudden movements may occur when the object of value is used. Furthermore, such solutions are not very suitable when the object of value has a given shape and/or weight (i.e., in the case of a handgun) that should not be modified by an external device such as a wire connection or battery.

In other known systems, the sensor energy supply is obtained from the object of value if it has a battery (such as in the case of a computer). Such being the case, objects of value which are monitored are not always powered electrically, which makes these existing solutions ill-suited.

One particular object of the invention is to mitigate the aforementioned disadvantages.

The present invention is to do with detecting certain events related to the use of an object of value, for example, the alarm may be raised automatically when a police officer uses his weapon. In such a case, the object of value (here a weapon) must be able to be used in a very mobile manner and the chosen solution should not impact the weight, shape or equilibrium of the object. In addition, the object of value is not itself powered electrically.

The object of a first aspect of the present invention is a method to monitor an object of value to optimize energy consumption, said object of value being equipped with an event detection device comprising:

- means of contactless communication with a remote entity;
- means for detecting an event related to the monitoring of an object of value;
- means for collecting energy;

said method being characterized in that the method comprises:

- a first step A of collecting energy by said detection device;
- a second step B, triggered following the detection of an event by said detection device, in the course of which the energy collected during said first step is restored such that:

- said detection device activates at least one contactless communication circuit of a remote entity or searches for one;
- said detection device transmits to said contactless communication circuit of said remote entity information relative to the event detected.

In a particular embodiment, the energy collected in step A is obtained by means of a MEMS (Micro-Electro-Mechanical System) system that may collect kinetic energy. Such systems may collect kinetic energy (for example, vibrations). The energy collection may be utilized as an emergency power source to recharge the battery of the event detection device during step A.

The means to store the energy within the event detection device may be a rechargeable battery of low thickness, particularly a lithium extra flat battery particularly adapted to power microprocessor cards (active smart cards). In such a case, the energy is available for some milliseconds upon detection of events, which is in conformance with the optimized use of energy according to the present invention.

The sensors are typically sensors enabling movements, positions, accelerations, locations, gas leaks, etc., to be detected. Among movement sensors, different means adapted to the detection of events are known to the person skilled in the art. Two categories mainly exist.

The first category is based on the use of inclination sensors based on mechanisms allowing the loss of verticality to be detected (mercury ball or metal ball). In such a case, the sensor must be suitably fixed to the object of value such that the object at rest does not start the alarm.

The second category is based on the use of a motion sensor that detects accelerations imposed on the object of value beyond a predefined acceleration threshold.

In a particular embodiment, when the object of value is a weapon, the fusion of data issued from measurements from an inclination sensor and a motion sensor connected to the weapon, is used to deduce that the weapon has only been removed from its case (for example, passage from a position adjacent to the horizontal to a position adjacent to the vertical for a handgun) or on the contrary to detect the percussion undergone by the firearm during a shot (acceleration beyond a predetermined threshold).

Another object of the invention is an event detection device related to the monitoring of an object of value implementing a method of monitoring an object of value according to the invention. The event detection device comprises at least:

- means of contactless communication with a remote entity;
- means for detecting an event related to the monitoring of an object of value;
- means for collecting energy;

Said event detection device being provided on said object of value.

In particular, the event detection device related to the monitoring of an object of value may also comprise means to store an indication that an event has been detected.

Moreover, the event detection device related to the monitoring of an object of value may also comprise means to reinitialize said information related to the event detected.

In a particular embodiment, information related to the detected event transmitted during step B may be constituted of previously stored information and/or additional information determined by means of a microcomputer.

In another embodiment, the event detection device is equipped with a radio communication interface in conformance with proximity interface standards ISO/IEC 14443 'Identification cards—Contactless integrated circuit cards—Proximity cards.'

In another particular embodiment, the event detection device is equipped with a radio communication interface in conformance with vicinity interface standards ISO/IEC 15693 'Identification cards—Contactless integrated circuit cards—Vicinity cards.'

Still another object of the invention is mobile communication equipment adapted to cooperate with an event detection device according to the invention, in which the mobile communication equipment comprises a radiocommunication interface allowing events to be reported to a central event management server, said interface being constituted of a professional mobile radio system.

In a particular embodiment, the mobile communication equipment may be, for example, a wireless modem.

In particular, one may provide that the radio communication between the mobile communication terminal and the event detection device aiming to provide to the terminal the information necessary for reporting events to the central event management server implements a low-consumption contactless interface. It may be, for example, in conformance with proximity interface standards ISO/IEC 14443 'Identification cards—Contactless integrated circuit cards—Proximity cards.' In this case, this communication may be established when the distance between the terminal and the event detection device is between approximately 4 cm and 10 cm. It may also be contemplated that the radio interface between the terminal and the event detection device is another type that supports the greatest distances between the terminal and the event detection device while keeping the advantages of contactless interfaces in terms of low energy consumption, such as, for example, vicinity interface standard ISO/IEC 15693 'Identification cards—Contactless integrated circuit cards—Vicinity cards.' This technology offers a good compromise between distance and energy consumption, which is of particular interest for objects of value to be used with a high degree of freedom of movement.

Radiocommunication means enabling events to be reported to a central event management server may be, for example, systems such as defined by the Telecommunications Industry Association (TIA) for the Association of Public-Safety Communications Officers (APCO) or as defined by the European Telecommunications Standards Institute through the Terrestrial Trunked Radio (TETRA) standard, or even by industrial forums such as the TETRAPOL forum.

In particular, one of the advantages of the invention is that it may be utilized to monitor any type of object of value, without significantly impacting the ergonomics or outer appearance of the object. Therefore, it remains possible to use the object of value under the same conditions as when the object is not being monitored.

Thus, an event detection device according to the invention is particularly suitable to the case where the object to be monitored is mobile. This is the case for the user himself (for example, in the case of systems for protecting lone workers) or for an object of value transported by the user (for example, a weapon). A device according to the invention presents the advantage of being able to be integrated into a situation of movement, including if the movements of the object of value user are fast, sweeping and/or irregular.

In an event detection device according to the invention, supplying energy to the sensor of the object situated on the object of value is ensured by the event detection device itself which enables the device to be autonomous in terms of energy with relation to the mobile communication terminal with which it cooperates for reporting events.

Such a device has the advantage of only requiring a relatively high energy consumption in the phase of activating the remote entity communication circuit. The rest of the time, during step A, the energy consumption of a system according to the invention is low.

Figure 2:
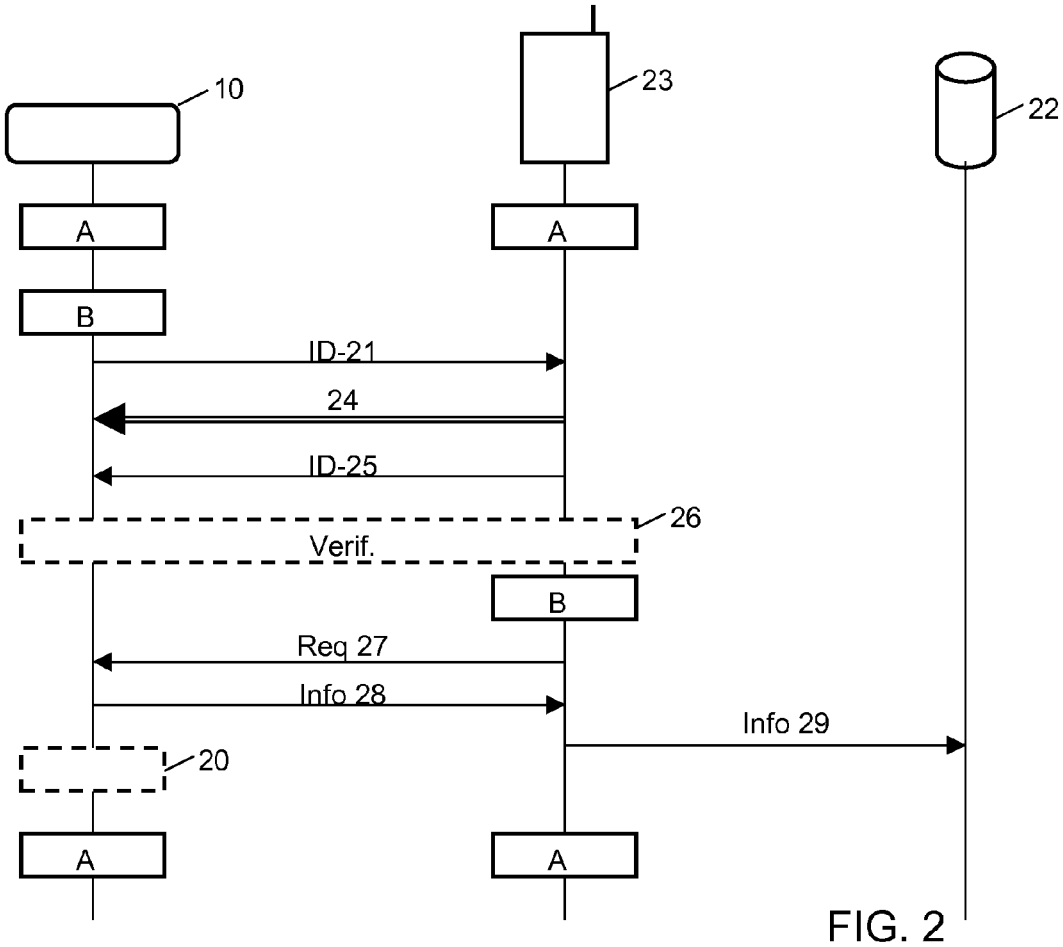
Figure 3:
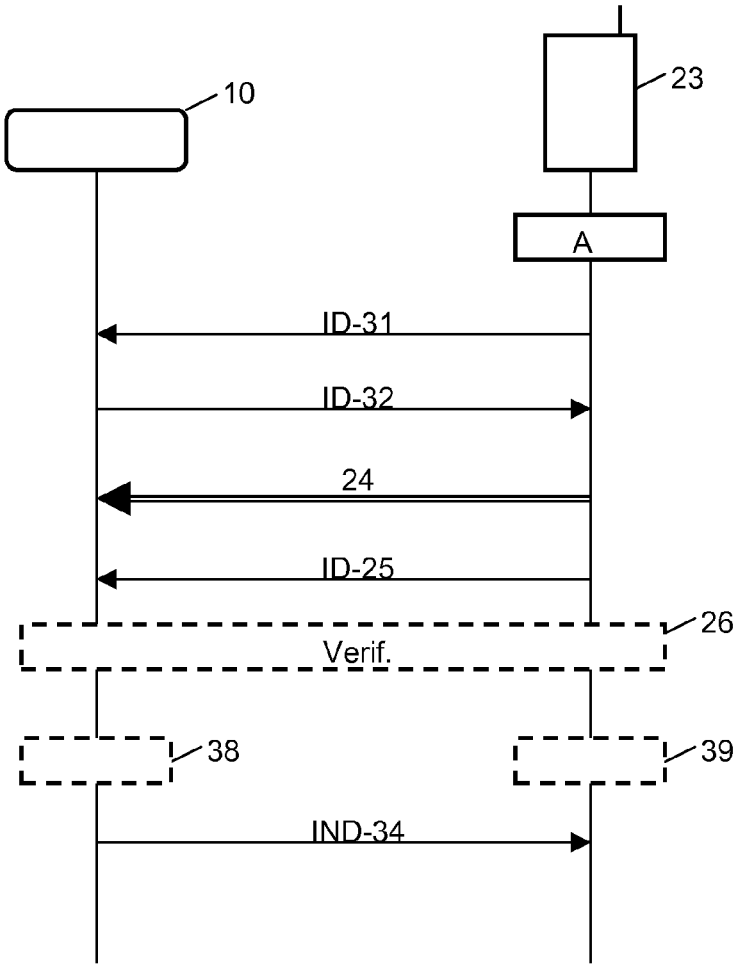
Figure 4:
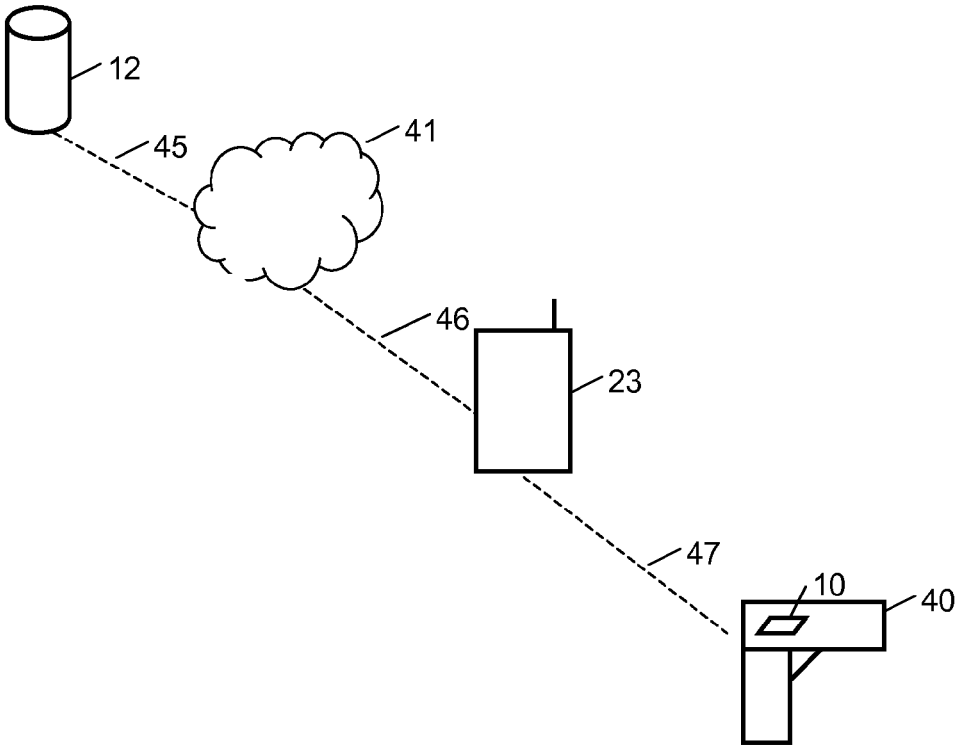

Other characteristics and advantages of the invention will appear more clearly upon reading the following description with regard to the attached drawings that illustrate:

FIG. 1, by a block diagram, a device for monitoring an object of value equipped with a sensor and adapted to optimize energy consumption, according to the invention;

FIG. 2, by a diagram, an exchange of messages between an event detection device according to the invention, mobile communication equipment according to the invention and a central event management server;

FIG. 3, an example of an exchange of messages between an event detection device according to the invention and mobile communication equipment according to the invention;

FIG. 4, a system for monitoring an object of value adapted to optimize energy consumption, and allowing events to be reported when the object of value is a handgun.

FIG. 1 illustrates, by a block diagram, a device for monitoring an object of value equipped with a sensor and adapted to optimize energy consumption, according to the invention. The device comprises a sensor 12 adapted for the detection of events to be monitored. It also comprises a contactless communication circuit 11. The contactless communication circuit 11 enables the device 10, following detection of an event, to establish a transaction with a remote object (for example, a piece of mobile communication equipment). During the transaction thus established, information related to the detected event is transmitted to a centralized event management server.

The event detection device 10 also comprises a unit allowing energy to be collected 13 and a unit allowing energy to be stored 14. In addition, the event detection device 10 optionally comprises a storage unit 15. The storage unit 15 enables, depending on the embodiment, an indication that an event has been detected to be stored or, as an alternative, information related to the detected event to be stored, this information may, if necessary, be transmitted, via the mobile communication equipment, to a centralized event management server.

FIG. 2 illustrates, by a diagram, an exchange of messages between the event detection device 10 according to the invention, mobile communication equipment 23 according to the invention and a centralized event management server 22.

Step A is a first step of collecting energy (also known as "energy harvesting") by the detection device 10 located on the object of value (typically a weapon). During this phase A, the object of value is in a state of rest (for example, a weapon put in its holster in keeping with the human carrying the object of value). Thus, the detection device may comprise MEMS type means whose function is, for example when the human carrier is walking, to transform the mechanical energy linked to the jerky effect of the walking into electrical energy. This energy collection step enables sufficient electrical energy to be had to, when an event linked to the object of value is detected (typically, the weapon is removed from its holster), switch to the second step B.

Thus, when an event is detected by the event detection device 10, the event detection device 10 switches from step A to step B. Optionally, an indicator that an event has been detected may be stored in storage unit 15. The event detection device 10, through its contactless communication circuit 11, then starts a phase of activating a remote entity through a message ID-21 containing the identification of the event detection device 10. This remote entity activation phase consists of searching for at least one remote entity (for example, a piece of mobile communication equipment 23 adapted to cooperate with said event detection device 10). The remote entity, after having transferred energy 24 to the event detection device 10, transmits to it a message ID-10 25 containing information related to its identity. The identity verification phase 26 (or mutual identity authentication) may then take place.

Thus, an event detection device according to the invention allows, depending on the context in which it is used, a suitable level of security to be ensured while minimizing the energy consumption time window.

According to a particular embodiment, during the phase of activating the remote entity through message ID-21, the identity of the remote entity or remote entities that is shown may be stored on storage unit 15 within the event detection device 10. In such a case, during a subsequent event detection, the event detection device 10 directly activates the known remote entity and the mutual identity verification phase 26 may be reduced.

When the mutual identity verification 26 has succeeded, the mobile communication equipment 23 switches to step B. Upon receipt of message Req-27 from the mobile communication equipment 23, the event detection device 10 transmits a message Info-28 containing the indication that an event has been detected.

In summary, detection of the event by the detection device 10 has the consequence of restoring the energy collected during step A to activate at least one piece of mobile communication equipment 23 and to reveal the event to the mobile communication equipment 23.

Optionally, this message Info-28 may also contain, in addition to the identity of the detection device, information concerning the type of event detected. For example, message Info-28 may contain the level reached when the threshold has been exceeded, such as in the case where the event detection device 10 equips the clothing of a fire fighter and comprises a sensor enabling a gas leak to be detected. In addition, message Info-28 may contain an indication of the type of detected event such as in the case where the event detection device 10 equips the weapon of a police officer and comprises a sensor enabling the theft of the weapon or the use of the firing pin of the weapon to be detected and differentiated.

The mobile communication equipment 23 may then start reporting the event to the centralized event management server 22. In particular, the mobile communication equipment 23 transmits a message Info-29 containing information related to the detected event to the centralized event management server 22.

Optionally, this information may also contain, in addition to the information received from the detection device 10, location information enabling the centralized event management server 22 to complete the processing of the event at the centralized event management server 22.

In sub-step 20, the event detection device 10 may then reinitialize the indication that an event has been detected. During this sub-step, the device may also reinitialize, depending on the embodiment considered, information related to the detected event. The detection device 10 then switches back to step A and resets to the energy collecting position pending detection of a new event. In addition, the radio communication equipment 23 may be switched back to step A.

FIG. 3 illustrates an example of an exchange of messages between the event detection device 10 according to the invention and mobile communication equipment 23 according to the invention. Elements that have already been referenced on other figures bear the same references.

In step A, the mobile communication equipment 23 periodically starts a phase of searching for an event detection device 10 by sending an identification message ID-31. Thus, any event detection device 10 situated in the vicinity or proximity of the mobile communication equipment 23 may be revealed by a response message ID-32 containing an identification of the event detection device. Upon receipt of a response message ID-32 from the event detection device 10, the mobile communication equipment 23 may store the information concerning the identity of the detection device 10 that is thus revealed. It may also, after having powered the event detection device 10 with energy 24, transmit to it a message ID-25 containing information related to its identity. The mutual identity verification phase 26 may then take place.

Thus the use of a device according to the invention has the particular advantage of minimizing the energy consumption time window. In addition, the efficacy of the energy budget comes from the fact that the mobile communication equipment periodically supplies energy again to the event detection device 10 such that it has a sufficient energy level when it detects an event.

Optionally, the mobile communication equipment 23 stores the identity of the event detection device 10 that is revealed in sub-step 39. In addition, the event detection device 10 may store the identity of the mobile communication equipment 23 in sub-step 38.

According to a particular embodiment of the invention, the event detection device 10 may also transmit a message IND-34 indicating if an event has already been detected, in which case the mobile communication equipment 23 will be able to switch to step B and continue, for example, according to the embodiment illustrated by FIG. 2.

Here FIG. 4 illustrates another aspect of the invention, a system of monitoring an object of value adapted for optimizing energy consumption, and allowing events to be reported when the object of value is a handgun. Elements that have already been referenced on other figures bear the same references.

Here the object of value 40 is a handgun equipped with an event detection device 10. In this embodiment, the event detection device 10 may be equipped with a movement, pressure or acceleration sensor or even a sensor triggering upon a combination of several events. In the case of a gas detection system, the event detection device 10 may be a sensor sensitive to a certain molecule or then reacting in case of a lack of oxygen.

The event detection device 10 also comprises a contactless communication circuit 11 able to establish a transaction 47 with mobile communication equipment 23 situated in proximity to or in the vicinity of the event detection device 10. The mobile communication equipment 23 is also able to establish communication 46 through a radiocommunication network 41 with a centralized event management server 22.

When the event detection device detects a specific utilization of the handgun, it switches to step B and starts reporting information related to the detection of events (for example, if the firing pin of the weapon was activated, or if the weapon was, pulled out from its nominal position at a speed exceeding a certain threshold, such as in the case of theft of the weapon).

The event detection device 10 disposes means of collecting 13 and storing energy 14.

The invention claimed is:

1. A method of monitoring an object of value to optimize energy consumption, said object of value being equipped with an event detection device comprising a circuit configured to provide contactless communication with a remote entity; a sensor configured to detect an event related to the monitoring of the object of value; and a unit configured to collect energy, said method comprising:

a first step (A) of collecting kinetic energy by said detection device;

a second step (B), triggered by the detection of an event by said detection device, of using the energy collected during said first step such that:

said detection device activates with said energy at least one contactless communication circuit of said remote entity or searches for one;

said detection device transmits with said energy to said contactless communication circuit of said remote entity information related to the detected event.

2. The method of monitoring an object of value to optimize energy consumption according to claim 1, wherein the energy collected in said first step (A) is obtained using a MEMS system that is configured to collect kinetic energy.

3. An event detection device adapted to monitor an object of value, the device comprising:

a circuit configured to provide contactless communication with a remote entity;

a sensor configured to detect an event related to the monitoring of the object of value, and a unit configured to collect kinetic energy;

wherein said event detection device is provided on said object of value, and wherein detecting the event triggers said detection device to (a) activate, or search for, with the energy collected, at least one contactless communication circuit of said remote entity, and (b) transmit, with the energy collected, to said contactless communication circuit of said remote entity information related to the detected event.

4. The event detection device adapted to monitor an object of value according to claim 3, wherein said information related to the detected event transmitted is constituted of previously stored information and/or additional information determined using a microcomputer.

5. The event detection device adapted to monitor an object of value according to claim 3, wherein said event detection device is equipped with a radio communication interface in conformance with proximity interface standards ISO/IEC 14443 'Identification cards—Contactless integrated circuit cards—Proximity cards.'

6. The event detection device adapted to monitor an object of value according to claim 3, wherein said event detection device is equipped with a radio communication interface in conformance with vicinity interface standards ISO/IEC 15693 'Identification cards—Contactless integrated circuit cards—Vicinity cards.'

7. A piece of mobile communication equipment adapted to cooperate with an event detection device adapted to monitor an object of value, the event detection device comprising a circuit configured to provide contactless communication with a remote entity; a sensor configured to detect an event related to the monitoring of the object of value, and a unit configured to collect kinetic energy; wherein said event detection device is provided on said object of value, and wherein detecting the event triggers said detection device to (a) activate, or search for, with the energy collected, at least one contactless communication circuit of said remote entity, and (b) transmit, with the energy collected, to said contactless communication circuit of said remote entity information related to the detected event, the mobile communication equipment comprising a radio communication interface allowing events received from said event detection device to be reported to a central event management server, said interface being constituted of a professional mobile radio system.

8. A method of monitoring an object of value to optimize energy consumption, said object of value-being equipped with an event detection device comprising:

a circuit configured to provide contactless communication with a remote entity;

a sensor configured to detect an event related to the monitoring of an object of value; and a unit configured to collect kinetic energy;

said method comprising collecting energy by said detection device; and using the kinetic energy collected by said detection device, when triggered by detecting an event by said detection device, to enable said detection device to (a) activate, or search for, at least one contactless communication circuit of said remote entity, and (b) transmit to said contactless communication circuit of said remote entity information related to the detected event.

9. The method of monitoring an object of value to optimize energy consumption according to claim 8, wherein said object of value is a weapon.

10. The event detection device adapted to monitor an object of value according to claim 3, comprising a storage unit configured to store an indication that an event has been detected.

11. The event detection device according to claim 3, wherein said object of value is a weapon.

12. The method of monitoring an object of value to optimize energy consumption according to claim 1, wherein prior to detecting an event by said detection device, the energy collected by said detection device does not power said detection device to activate, or search for, said at least one contactless communication circuit of the remote entity.

13. The method of claim 1, wherein the event is at least one of a movement, a change in position, an acceleration of the object of value.

14. The piece of mobile communication equipment of claim 7, wherein the event is at least one of a movement, a change in position, an acceleration of the object of value.

15. The method of claim 8, wherein the event is at least one of a movement, a change in position, an acceleration of the object of value.

16. The event detection device of claim 3, wherein the event is at least one of a movement, a change in position, an acceleration of the object of value.

17. The method of claim 1, wherein activation of the at least one contactless communication circuit of said remote entity by said detection device using said energy includes a transmission to the remote entity of a message containing identification of the detection device prior to transmitting said information related to the detected event to said remote entity.

18. The method of claim 17, wherein following transmission of said message containing identification of the detection device, and prior to transmitting said information related to the detected event to said remote entity, the method comprises receiving by said detection device from said remote entity a message containing identification of the remote entity.

19. The method of claim 17, wherein following transmission of said message containing identification of the detection device, and prior to transmitting said information related to the detected event to said remote entity, the method comprises receiving energy by said detection device from said remote entity.

20. The method of claim 1, wherein prior to transmitting said information related to the detected event to said remote entity, the method comprises receiving energy by said detection device from said remote entity.

* * * * *